US006679492B2

(12) United States Patent
Markowiak

(10) Patent No.: US 6,679,492 B2
(45) Date of Patent: Jan. 20, 2004

(54) METHOD OF PLAYING A BETTER GAME USING SPECIAL PAYOFF TABLES

(76) Inventor: Jaroslaw Markowiak, 6000 Running Springs Rd., Ukiah, CA (US) 95482

( * ) Notice: Subject to any disclaimer, the term of this patent is extended or adjusted under 35 U.S.C. 154(b) by 358 days.

(21) Appl. No.: 09/769,078

(22) Filed: Jan. 24, 2001

(65) Prior Publication Data

US 2002/0096827 A1 Jul. 25, 2002

(51) Int. Cl.[7] ..... A63B 71/00

(52) U.S. Cl. ..... 273/138.1; 273/274; 273/292; 273/309; 463/12; 463/22

(58) Field of Search ..... 273/138.1, 292, 273/309, 274; 463/12, 22, 27

(56) References Cited

U.S. PATENT DOCUMENTS 5,490,670 A * 2/1996 Hobert ..... 273/138
5,570,885 A * 11/1996 Ornstein ..... 463/17
5,718,431 A * 2/1998 Ornstein ..... 273/274
5,788,574 A * 8/1998 Ornstein et al. ..... 273/309
5,795,226 A * 8/1998 Yi ..... 273/138.1
5,806,846 A * 9/1998 Lofink et al. ..... 273/292
5,851,010 A * 12/1998 Feinberg ..... 273/138.1
5,934,998 A * 8/1999 Forte et al. ..... 273/292
5,984,779 A * 11/1999 Bridgeman et al. ..... 273/138.2
6,000,699 A * 12/1999 Long ..... 273/292
6,113,102 A * 9/2000 Marks et al. ..... 273/292
6,270,405 B1 * 8/2001 Ferguson ..... 273/138.1

* cited by examiner

*Primary Examiner*—Benjamin H. Layno
*Assistant Examiner*—Dolores Collins
(74) *Attorney, Agent, or Firm*—Rob L. Phillips; Quirk & Tratos

(57) ABSTRACT

A method of playing a betting game using a special payoff table is utilized. Winning a round of play entitles players to the predetermined payoff. The payoff tables are carefully constructed to accommodate enhanced payoffs. Players are offered jackpots for winning consecutive rounds of play in games that previously did not offered it. Special bonuses are offered for arrangements specific to the particular game, thus interest of the desired outcomes is broaden. Players that won at least one round of play but then lose, trying to obtain number of consecutive wins that would qualify them for a jackpot, still receive a reward. The house edge changes from round to round, and favors players continuing betting after their wins. This method of playing can be used as the main betting system or as a side bet.

24 Claims, 3 Drawing Sheets

| | | | | | | | | | | | |
|---|---|---|---|---|---|---|---|---|---|---|---|
| 1 | 2 | 3 | 4 | 5 | 6 | 7 | 8 | 9 | 10 | 11 | 12 |
| 1 | 1.5 | 2 | 2.5 | 3 | 3.5 | 4 | 4.5 | 5 | 5.5 | 6 | 1000 |
| 50 | 44 | 38 | 33 | 30 | 28 | 27 | 26 | 25 | 25 | 24 | 1 |

| | | | | | | | | | | | |
|---|---|---|---|---|---|---|---|---|---|---|---|
| 1 | 2 | 3 | 4 | 5 | 6 | 7 | 8 | 9 | 10 | 11 | 12 |
| 0 | 1 | 1 | 1 | 2 | 2 | 3 | 5 | 10 | 20 | 50 | 1000 |
| 52 | 40 | 34 | 31 | 28 | 27 | 26 | 25 | 24 | 24 | 22 | 6 |

| | | | | | | | | | |
|---|---|---|---|---|---|---|---|---|---|
| 1 | 2 | 3 | 4 | 5 | 6 | 7 | 8 | 9 | 10 |
| 0 | 0 | 0.5 | 1 | 2 | 3 | 4 | 5 | 10 | 200 |
| 52 | 52 | 47 | 40 | 34 | 29 | 27 | 25 | 24 | 2 |

METHOD OF PLAYING A BETTER GAME USING SPECIAL PAYOFF TABLES

CROSS-REFERENCE TO RELATED APLICATION

Not Applicable

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO MICROFICHE APPENDIX

Not Applicable

BACKGROUND OF THE INVENTION

This invention relates generally to games of chance found in casinos and other legal gambling establishments and more particularly to a gaming system which can be used to play blackjack, roulette, craps, and baccarat either at a table or an electronic networking system or a video machine or slot machine.

The growth of the gaming industry in the last decade has been phenomenal. In those areas of the United States and the rest of the world where gambling is legal, there is a constant demand and need for new or improved games of chance to attract gamblers to casinos and other gaming establishments. At the same time, there is growing number of players who have become familiar with traditional games of chance and gaming machines such as slot machines, video games, blackjack tables, roulette tables, baccarat tables and crap tables. Therefore, it is desirable that any new gaming machine or system, which, while taking advantage of this familiarity create new or added interest in the game.

Many games that enjoy relative popularity offer chance of winning close to fifty percent. However, they lack the attractiveness of other games that offer large jackpots.

There were many attempts to incorporate new ways of betting into established games, but most of them were unsuccessful. Inventors either tried to introduce new arrangements, like in U.S. Pat. No. 5,806,846 issued to Lofink, et al., that are too extraneous to conventional games; or players were giving up playing games knowing transient chances of obtaining premium arrangements, or games facilitators had a (too) huge advantage over players. Some inventors tried to introduce new arrangements, like in U.S. Pat. No. 5,934,998 issued to Forte, at al. or in U.S. Pat. No. 6,113,102 issued to Marks, et al., which may be too complicated and thus distracting from the traditional game. Some new propositions included side bets that offered desirable jackpots, like in U.S. Pat. No. 5,718,431 issued to Ornstein, but this invention rewarded only one player-chosen number of consecutive wins and the players would be better off just parlaying—betting an original amount and its winnings on a subsequent round of play.

What is needed, then, is a gaming method which can accommodate one or more gamblers while allowing for multiple play wagering, and offering both, small and big jackpots; a method that increases players advantage with subsequent bets, thus inducing them to play more and longer; what is needed, is a new method that broadens interest in the expected outcome—yet preserves the integrity and rules of the established game. Such a noncomplicated and yet efficient methods are lacking in the prior art.

BRIEF SUMMARY OF THE INVENTION

This new method of playing a game of chance uses special payoff tables, where player upon winning his/her bet has a right to be paid accordingly to the payoff table; unless payoff is requested, the winning bet automatically becomes the bet for the next round of the game; except for losing bet in the first round, players are awarded payoffs for losing bets; jackpots and special bonuses might easily be included it the game.

Accordingly, several objects and advantages of my invention are:

A gaming method for the casino or other game facilitator to provide interesting, exciting and absorbing prospect for gamblers, where casino profits are easily adapted and changed to required needs.

It is a feature and accomplishment of the present invention to provide a natural method with no, or minimal, changes to an established game.

It is another feature and advantage of the present invention to provide a new betting system that can be the main and the only betting system or that it can be used as a side bet—used concurrently with conventional betting system.

Other objects and advantages of the present invention is to provide a new method of playing a game that offers variety of higher payoffs—small, medium and large jackpots.

Other objects and advantages of the present invention is to provide bonuses for arrangements that are typical for the particular game, called intrinsic arrangements, thus keeping the conventional rules and at the same time making the game more attractive as the interest in awaited outcome of the game is broaden.

Yet, another objects and advantages of the present invention is to provide a more exciting game by making players feel that, while trying to win a big jackpot, even if they lose a round, before achieving the jackpot, they still would be eligible for some bonuses. These, together with other objects and advantages, which will be subsequently apparent, reside in the details of the present invention more fully herein described and drawn.

BRIEF DESCRIPTION OF THE SEVERAL VIEWS OF THE DRAWING

FIG. 3 is a view of a win button indicating earned payoff.

FIGS. 4A–4D are illustrations of exemplary payoff tables designed for different games of chance and having different house edge and different size of jackpots.

DETAILED DESCRIPTION OF THE INVENTION

The present invention is based, in part, on the discovery that successful method of playing a betting game must be a compromise between casino or other game facilitator trying to maximize profits from the game and players or gamblers wanting to maximize their wins and minimize their loses, and at the same time players expecting the process of playing the game to be a form of entertainment. It was discovered that players are attracted to games that are easy to play, and which offer big jackpots, even though the chance of winning the jackpot remains small. When players miss the targeted jackpot they like to get any other bonus, as "a win is a win", or what could be called a consolation prize. Also, players like bonuses, or "surprise" prizes for occurrences of specific game related situations, or arrangements intrinsic to the particular game—as long as these arrangements are not distracting from the traditional way of playing, and foreign to the core of the game.

Attractiveness of the game encourages players to play, which in turn equals more playing time, and more playing time allows casino to lower casino advantage, called house edge (though it is not obligatory). Lower house edge, which is still profitable, brings in even more play. This is the way for a successful game, and the blueprint for this invention.

All those heretofore mentioned attributes could be achieved when the right payoff tables are constructed. The most important part of the payoff tables is casino profit.

Casino profit might be measured in a few ways, one of them being house edge—most often presented as a percentage of the amount of money won by casino to the total amount of money wagered. House edge is often calculated using model of mathematically perfect player play. In the gaming industry odds are the ratio of the payoff to the bet. We say that casino pays true odds if the value of a bet divided by its payoff is the same as the chance of occurrence of the event for which payoff is rewarded.

Casino profit is generally obtained by underpaying true odds. Most often casino either structure payoffs in a special way to retain some percentage of the bet money (usually ranging from one percent to about five percent) when the bet is resolved. The other method of generating profit is to make even payoff 1 to 1 and structure the chances of winning the bet just under fifty-percent. House edge most often stays the same throughout the game.

In this invention payoff tables are carefully constructed to make profit for casinos, to offer to players special jackpots and bonuses, and to induce players to continue to play longer by providing a bigger mathematical advantage to the bet that follows a winning bet.

Figures 3, 4A, 4B, 4C:
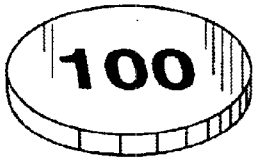

In FIGS. 4A through 4C, the top row represents numbers of consecutive rounds played. The middle row represents the amount of the original wager, also called earned, to which a player is entitled to for winning corresponding number of consecutive rounds. The bottom row represents the house edge if the game would be finished at the corresponding round of play, and all wings were paid off.

In FIG. 4A, the numbers in the second row represent payoffs that may be paid to the player, and the casino keeps the original bet. This form of paying out is called "paying x FOR y." This table is constructed for any game of chance where the chance of winning a round is fifty percent, and the payoff table includes a large jackpot.

In FIG. 4B, the numbers in the second row represent payoffs that may be paid to the player, and the original bet is returned to the player. This form of paying out is called "paying x TO y." This payoff table is constructed for the typical game of blackjack where the chance of winning a round is just over 48% percent, and the payoff table includes both, small and big jackpots.

In FIG. 4C, the numbers in the second row are payoffs in addition to returning the original bet. This payoff table is constructed for the typical game of blackjack where the chance of winning a round is just over 48% percent and the payoff table includes both, small and medium jackpots, also, all pushes and all blackjacks (player receiving an Ace and a ten value card) receive bonuses equal to the last earned value of the payoff table multiplied by value of the original bet.

Looking at the FIGS. 4A through 4C we can see that payoff tables are deliberately constructed in such a way that the house edge gets smaller for each bet following a win. Thus, players' advantage increases creating an incentive to continue playing the game. Values of the house edge are clearly descending. However, this trend may be interrupted, for example, by setting one or more of the payoff numbers to the rounded figures.

To afford paying out extra jackpots and bonuses and at the same time to preserve casino's profitability, some payoffs have to be smaller then true odds for the particular game. This happens mostly in the first (or in the first few) round of play. Though, normally players would be deterred from a game in which casino has an edge of between 12% and 100%, such edge is acceptable in this method of playing a game, since players' chances improve with the consecutive rounds.

The idea of underpaying true odds exists in the U.S. Pat. No. 5,984,779 issued to Bridgeman, at al., but the degree of underpayment in relation to the winnings is not specified. House edge values have no correlation to the consecutive wins and this patented method is used to build a fluctuating prize pool for non-seeded and non-house banked games.

Values of the payoff tables can be easily adjusted to the required house edge, and also they can be easily created as a natural sequence of numbers.

Values of the payoff tables could also be used to indicate the amount of bonuses players receive for arrangements that are characteristic to the game of chance being played. This intrinsic arrangements could trigger pay outs not only for rounds that are won by player but also for rounds that may require another round of play to determine the winner, for example, pushes in the game of blackjack and ties in the game of baccarat.

In the conventional game of craps, on a come out roll, numbers 2 and 3 win a bet for the "don't" players. Numbers 7 and 11 win, and number 12 loses a bet for the "do" players. Once the point is established these numbers, which are intrinsic to this game become of no interest to players playing do or don't side. They are neutral and bear no consequences for most of the placed bets. In my invention this is an excellent opportunity to award special bonuses for occurrences of such arrangements.

Rewarding players for the above mentioned, as well as other, arrangements broadens interest in the outcome of the played game. For example, if a player has been already awarded (earned) value of, let's say, seven and in this particular round s/he pushed—instead of that round being no-event—s/he would be awarded seven times her/his original bet. This is the way for the gaming system of this invention to obtain a new level of attractiveness.

Figure 1:
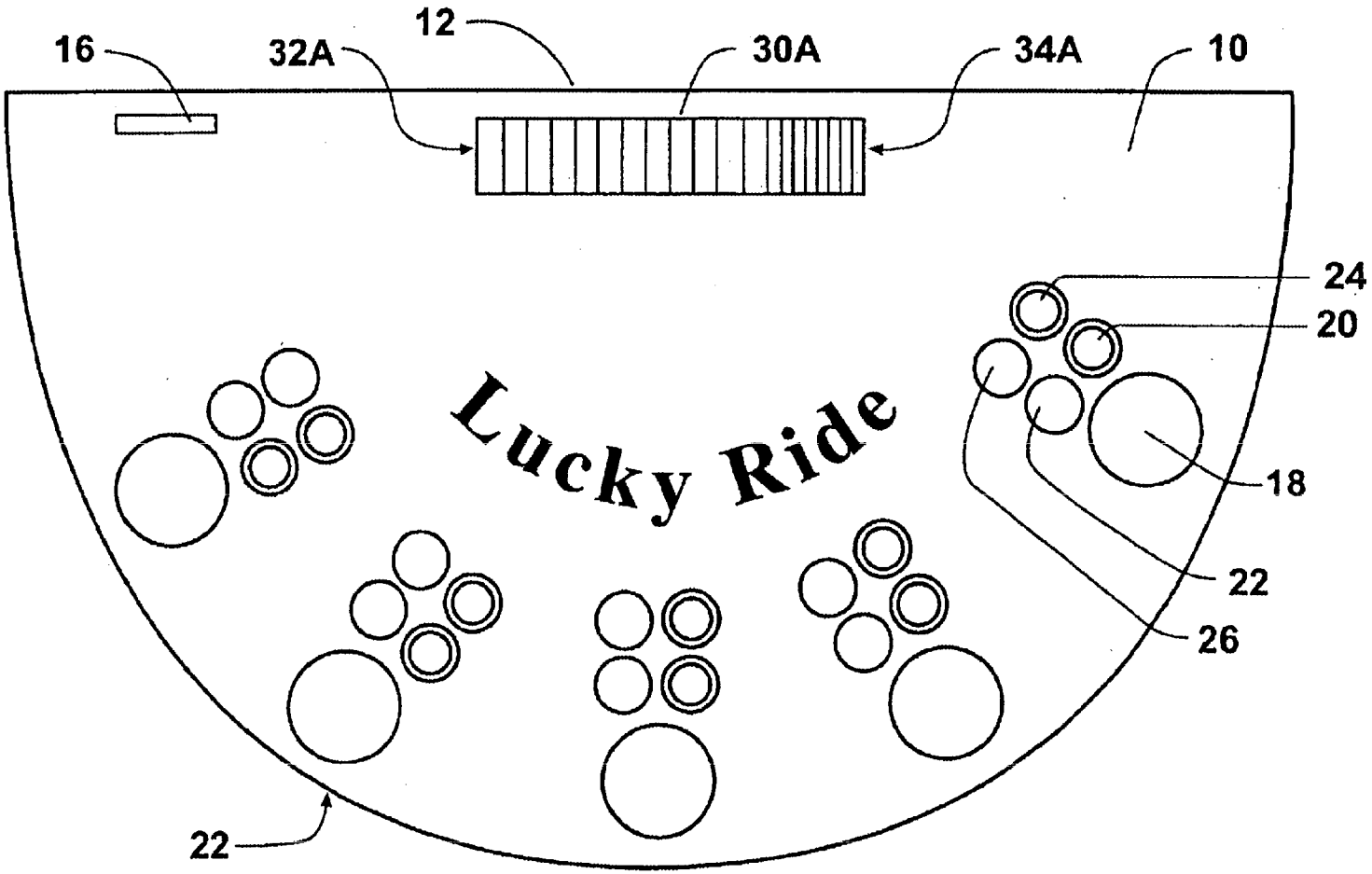
FIG. 1 is a plan view of a first embodiment of the system of the present invention in which the game of chance is blackjack played at a multiple player blackjack table.

Referring to FIG. 1, a first embodiment of the gaming system is shown. In this embodiment, the game of chance is blackjack, a game having rules and objectives well known to those of ordinary skill in the art as well as those in the gaming community as a whole. In gaming casinos, blackjack is conventionally played at a blackjack table 10 having multiple player seating areas 14 to allow more than one player to participate at single table 10. The game is run by a dealer who stands in the dealer area 12. The dealer area 12 and multiple player seating areas 14, including the players' conventional betting areas 18. Betting areas 18 are provided for each player to receive a chip or chips representing a conventional blackjack bet. Placed convenient to each player seating area 14 and betting area 18, and convenient to the dealer, is a betting area 20 for the first variant of this game, and another betting area 22 for the second variant of this game, in which are placed chips utilized for the conventional blackjack bet. Casino has an option of using one or more variants of the game. The conventional blackjack bet may be placed in a betting area 18 when the player makes a bet for the first or for the second or for both variants of the new game of this invention, which in this paragraph for clarity I will call "new game".

Betting areas for accepting bets are presented as circles but can be of almost any shape as long as they are function to accommodate circular-shaped chips, as is currently the standard in casinos.

The chip-receiving regions 20 and 22 may carry a specific name given respectively to these two variants of the game. Adjacent to each of the chip-receiving areas 20 and 22, in the direction toward the dealer is a win button receiving area 24 for the bet in circle 20, and a win button receiving area 26 for the bet in circle 22. Chips won by casino and chips used for payoff are kept in the chip tray 30A that has multiple of rows 32A for holding the regular playing chips and multiple of rows 34A for holding the win buttons (FIG. 3). Display of predetermined payoff tables 16, for all variants of the offered new game is placed to be conveniently seen by all players.

Prior to selecting a bet for one or both variants of the new game, the player makes a conventional bet by placing a chip (or a number of chips), representing currency, within betting circle 18.

The new game bet is indicated by placing a chip (or chips) of the desired denomination on the desired chip-receiving region, which is one, or both of the regions 20 or 22.

After the play of the first round of the game of blackjack the dealer removes bets from all betting regions and places them in the blackjack chip rack 30A if the player lost the round.

Upon winning the first round of the game, the dealer pays out the conventional bets in the conventional way. The new game bet remains in its betting region, and the dealer picks the first winning button from the win buttons rows 34A of the blackjack chip tray 30A, representing the first value from the payoff tables 16 for the corresponding variant of the game, and places this win button into the win button receiving region.

The win button, preferable round, chip like puck, having a value denomination printed or pressed on the surface, as exemplified in FIG. 3, represents "earned" value of the bet. Its denomination multiplied by the value of the original bet is paid to the player upon cessation of the game, or upon losing a round.

For every consecutive round win the dealer replaces the previously awarded (earned) win button with the new win button having the sequential value from the payoff table.

Player does not places a new bet until he is paid out for his/her bet. Player's bet upon winning a round is automatically brought into betting for the next round, unless player wishes to stop playing the game.

Casino may elect to have the payoff table with a relatively short or long series of values. After having all the values from the payoff table being awarded to the player, e.g. the player wins casino established limited number of consecutive wins, the dealer pays out the amount indicated by the highest payoff table number. In the next round the player places bet in the bet-receiving region and upon winning the round the new series of payoffs begins.

Rounds of the game that end up as pushes have no effect on the win button.

However, caissons may opt to regard a push as a bonus-qualifying event. The player who pushed the round gets paid multiplication of the original bet and denomination of the earned win button.

Another arrangement that could pay a bonus is a blackjack (an Ace and a ten-value card). However, if the player receives a blackjack and wins the round, s/he would not only be paid the bonus but also his/her earned win button would be replaced win the new win button of higher denomination, as with any other round won.

Figure 2A:
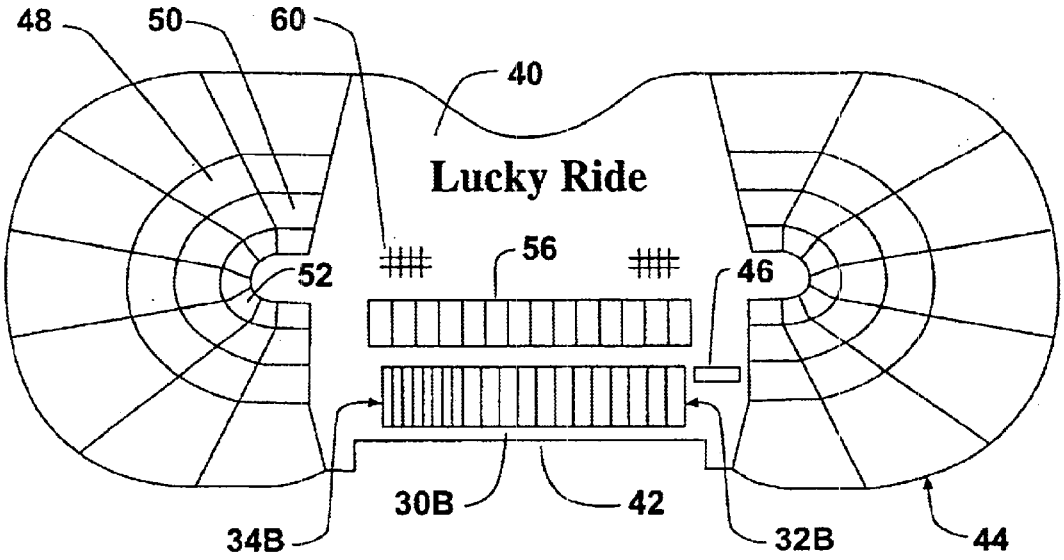
FIG. 2A is a plan view of a second embodiment of the system of the present invention in which the game of chance is baccarat.

FIG. 2A shows a second embodiment of the playing method in which the game of chance is baccarat, played at a baccarat table 40, having multiple player seating areas 44 distributed around table 40 and a dealer area 42. Each player seating area 40 has traditional betting areas: betting area for Bank 48, betting area for Player 50, betting area for Tie 52. Discerning from a conventional table also there is a special chip-receiving regions and score tally 60, further detailed in FIG. 2B. The baccarat chip tray 30B has multiple of rows 32B holding the regular playing chips and multiple of rows 34B for holding the win buttons is located next to vigorish tally 56.

Figure 2B:
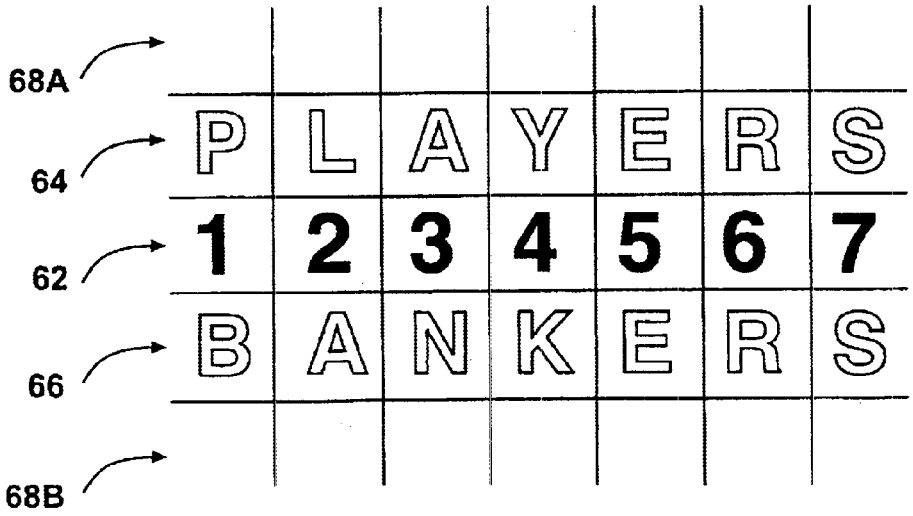
FIG. 2B is a view in detail of the portion indicated by the reference number 60 in FIG. 2A. This is a plan view of the table layout region for chip-receiving regions and score tally.

FIG. 2B shows a detailed plan view of chip-receiving regions and score tally 60. Centrally located is a multiple of player identifying squares 62, each square carrying a numeric sign representing a player at the corresponding seat from the multiple of player seats 44.

Multiple of Player chip-receiving regions 64 constitutes a raw of squares, each carrying a letter and letters making word: players, and each square is adjoining to the corresponding player identifying square.

Multiple of Bank chip-receiving regions 66 constitutes a raw of squares, each carrying a letter and letters making word: bankers, and each square is adjoining to the corresponding player identifying square.

Multiple of (Player bet) win button receiving regions 68A constitutes a raw of squares, and each square is adjoining to the corresponding Player chip-receiving region.

Multiple of (Bank bet) win button receiving regions 68B constitutes a raw of squares, and each square is adjoining to the corresponding Bank chip-receiving region.

Display of the predetermined payoff table 46 is placed to be conveniently seen by all players.

The game of baccarat is played in the conventional manner with bets for the game of present invention being handed to the dealers. The dealers place the bets either on the Player side 64 or on the Bank side 66 of the chip-receiving regions. Bets that lost the round are collected into baccarat chip tray.

Upon winning a round player is awarded the first win button indicating first value from the payoff table. The dealer places the win button either on the players 68A or on the bankers 68B side of the win button receiving regions.

The process of paying off baccarat game is identical to the one described above for the game of blackjack.

If the result of the round is Tie then the round has no effect on the win button earned by a player.

However, casino may opt to regard a Tie round as a bonus-qualifying event. The player who had a bet for the game, either on bank side or on player side, would get paid multiplication of the original bet and denomination of the earned win button.

Another arrangement that could pay a bonus is when the total of all cards issued to Bank at the end of the round is zero, called point count zero for Bank, when Player wins and the player had his/her bet on Player.

Another arrangement that could pay a bonus is when the total of all cards issued to Bank at the end of the round is zero, called point count zero for Bank, when Player wins and the player had his/her bet on Player.

Another arrangement that could pay a bonus is when the total of all cards issued to Player at the end of the round is zero, called point count zero for Player, when Bank wins and the player had his/her bet on Bank.

The prior art as presented by Marvin Ornstein in U.S. Pat. No. 5,570,885, and in U.S. Pat. No. 5,718,431, and in U.S. Pat. No. 5,788,574, has some similar ideas, mainly rewarding players for consecutive wins. Ornstein's games require player to pick one specific number of consecutive wins and if the player loses a round of the game before the specified player-chosen number of wins is achieved s/he loses the whole bet. In my invention losing a round of a game after a win is regarded as a result entitling to a reward. The house edge of the above mentioned prior art has no intentional trend, and players would retain better advantage by parlaying their bets; that game does not offer any additional bonuses and players can not stop playing without losing or forfeiting their whole bets.

The method of playing a game of present inventions brings new, exciting and intriguing features to well establish games;

This gaming system does not require complicated additions to the existing games, playing the game is fast-paced, simple and entertaining;

This gaming system provides player with a chance of more numerous small jackpots, as well as, medium, and large jackpots;

Players feel good as they are rewarded after wining a single round of play;

It provides player with a feeling of "free ride" after winning initial bet(s);

It provides player with a "consolation" prizes if the jackpots are not won;

It provides player with a chance of winning a surprise bonuses;

It is easy to play ("just put the wager in the betting circle and collect the winnings");

It broadens interest of the outcome of every round of the game by including arrangements that are rewarded with special bonuses;

It has "intuitive" easy to remember sequence of numbers as a payoff;

It doesn't require any special equipment other then a betting area and buttons to identify guaranteed payoffs;

For the game facilitator it is easy to obtain the required house edge;

It may bring new players to the established game, which otherwise would be considered tried and boring;

It may induce players to keep playing longer;

It provides a tool for gaming tournaments;

It may provide casinos with extra (however slight) profits by the players deviating from optimal way of playing the game;

This betting method is less prone to cheating and dealer-player collusion as jackpots are not instantaneous.

As would be apparent to those skilled in the relevant art, the invention can be embodied in a wide variety and forms of media, but not limited to, single and multi-player slot machines, single and multi-player video slot machines, as well as in-flight, at home and single, or in a network, including Internet linked machines legally controlled by a game facilitator.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention I claim:

1. A method of wagering on the outcomes of one or more played primary wagering games comprising the steps of:

a) accepting a primary game wager according to conventional rules of the primary wagering game;

b) accepting a separate wager to be resolved once a primary wagering game loss occurs, said separate wager resulting in a player reward as lone as one primary game win is realized;

c) conducting a round of the primary wagering game such that a win or loss is determined;

d) should play of the primary wagering game result in a loss, collecting said primary game wager and said separate wager;

e) should play of the primary wagering game result in a win, paying said player according to a payout table related to the primary wagering game;

f) repeating steps a, c and d until a primary wagering game loss occurs; and g) then rewarding said player based on the separate wager according to a pay table related to one or more consecutive primary wagering game wins realized by said player prior to the primary wagering game lass.

2. The method according to claim 1 further including means for tracking the player's consecutive number of primary wagering game wins.

3. The method according to claim 1 wherein said primary wagering game is selected from the group of games consisting of blackjack, baccarat and craps.

4. The method according to claim 1 wherein said pay table related to the number of consecutive primary wagering game wins realized by said player includes pay outs up to a pre-established maximum number of consecutive wins.

5. The method according to claim 4 wherein if said player achieves the pre-established maximum number of consecutive wins, said player is paid according to the pay table related to the number of consecutive primary wagering game wins realized by said player and then said consecutive win total is re-set to zero.

6. The method according to claim 1 further including a step of paying a bonus amount based on intrinsic primary wagering game outcomes.

7. The method according to claim 6 wherein said primary wagering game is blackjack and the intrinsic outcomes are selected from a group consisting of the occurrence of ties and blackjacks.

8. The method according to claim 6 wherein said primary wagering game is baccarat and the intrinsic outcomes are selected from a group consisting of the occurrence of ties, point count zero for bank when player wins and point count zero for player when bank wins.

9. The method according to claim 6 wherein said primary wagering game is craps and the intrinsic outcomes are selected from a group consisting of the occurrence of the numbers 2, 3, 7, 11 and 12 rolled after a point is established.

10. The method of claim 1 wherein said player may elect to collect the separate wager pay out based on the number of consecutive win at any time after a first primary wagering game win and prior to a wagering primary game loss.

11. A method of wagering on the outcomes of one or more played primary wagering games comprising the steps of;

a) accepting a first primary game wager according to conventional rules of the primary wagering game;

b) accepting a separate wager to be resolved once a primary wagering game loss occurs, said separate wager resulting in a player reward as long as one primary game win is realized;

c) conducting a round of the primary wagering game such that a win or loss is determined;

d) should play of the primary wagering game result in a loss, collecting said primary game wager and said separate wager;

e) should play of the primary wagering game result in a win, paying said player according to a payout table related to the primary wagering game;

f) repeating step c) until a primary wagering game loss occurs; and g) then rewarding said player based on the separate wager according to a pay table related to the number of one or more consecutive primary wagering game wins realized by said player prior to the primary wagering game loss.

12. The method according to claim 11 further including means for tracking the player's consecutive number of primary wagering game wins.

13. The method according to claim 11 wherein said primary wagering game is selected from the group of games consisting of blackjack, baccarat and craps.

14. The method according to claim 11 wherein said pay table related to the number of consecutive primary wagering game wins realized by said player includes pay outs up to a pre-established maximum number of consecutive wins.

15. The method according to claim 14 wherein if said player achieves the pre-established maximum number of consecutive wins, said player is paid according to the pay table related to the number of consecutive primary wagering game wins realized by said player and then said consecutive win total is re-set to zero.

16. The method according to claim 11 further including a step of paying a bonus amount based on intrinsic primary wagering game outcomes.

17. The method according to claim 16 wherein said primary wagering game is blackjack and the intrinsic outcomes are selected from a group consisting of the occurrence of ties and blackjacks.

18. The method according to claim 16 wherein said primary wagering game is baccarat and the intrinsic outcomes are selected from a group consisting of the occurrence of ties, point count zero for bank when player wins and point count zero for player when bank wins.

19. The method according to claim 16 wherein said primary wagering game is craps and the intrinsic outcomes are selected from a group consisting of the occurrence of the numbers 2, 3, 7, 11 and 12 rolled after a point is established.

20. The method of claim 11 wherein said player may elect to collect the separate wager pay out based on the number of consecutive win at any time after a first primary wagering game win and prior to a wagering primary game loss.

21. A method of wagering on the outcomes of one or more played primary games including:

a) accepting a wager to be resolved once a primary game loss occurs, said wager resulting in a player reward as long as one primary game win is realized;

b) playing a round of the primary game such that a win or loss is determined c) should play of the primary wagering game result in a loss, collecting said primary game wager and said separate wager;

d) should play of the primary wagering game result in a win, repeating step b) a primary wagering game loss occurs; and e) then rewarding said player based on the separate wager to a pay table related to one or more consecutive primary wagering game wins realized by said player prior to the primary wagering game loss.

22. The method of claim 21 wherein said player may elect to be paid according to a pay table related to the number of consecutive primary game wins realized by said player at any time after a first primary wagering game win and prior to a wagering primary game loss.

23. The method of claim 21 wherein the pay table is based on the number of consecutive wagering game wins realized by the player placing an original wager comprising:

a) providing pay outs corresponding to at least four consecutive wins;

b) providing a final pay out significantly larger than a first pay out and at least twice as large as an immediately preceding pay out;

c) providing that the first pay out represents twenty to eighty percent of total pay outs of said pay table; and d) providing a trend of decreased house edge and increased player odds for a majority of the successive pay outs.

24. The method according to claim 23 wherein a decreased house edge and increased player odds of step d) are provided for each successive pay out.

* * * * *